United States Patent [19]

Yeager et al.

[11] 4,165,909

[45] Aug. 28, 1979

[54] ROTARY ZIF CONNECTOR EDGE BOARD LOCK

[75] Inventors: Marvin L. Yeager, Carlisle; Jerome A. Desso, Steelton, both of Pa.

[73] Assignee: AMP Incorporated, Harrisburg, Pa.

[21] Appl. No.: 876,458

[22] Filed: Feb. 9, 1978

[51] Int. Cl.[2] ..... H01K 13/20

[52] U.S. Cl. ..... 339/75 MP; 339/176 MP

[58] Field of Search ..... 339/74 R, 75 R, 75 MP, 339/75 M, 176 MP

[56] References Cited

U.S. PATENT DOCUMENTS

| | | | |
|---|---|---|---|
| 3,569,904 | 3/1971 | Hill | 339/75 MP |
| 3,611,259 | 10/1971 | Palecek | 339/74 R |
| 3,638,167 | 1/1972 | Occhipinti | 339/74 R |
| 3,793,609 | 2/1974 | McIver | 339/176 MP X |
| 3,899,234 | 8/1975 | Yeager | 339/74 R |
| 3,977,747 | 8/1976 | Broutros | 339/74 R |
| 3,982,807 | 9/1976 | Anhalt | 339/75 MP |

*Primary Examiner*—Joseph H. McGlynn
*Assistant Examiner*—John S. Brown
*Attorney, Agent, or Firm*—Russell J. Egan

[57] ABSTRACT

A locking device is disclosed for use in combination with a known rotary cam, zero insertion force edge board connector. The locking device insures that a board will be correctly positioned in the connector before the contacts of the connector can be actuated into engagement with the board and prevents the board from being removed axially once it is in place. The subject locking device is particularly useful in instances of tandem edge board connectors when one of the series is in a relatively remote and/or inaccessible position. The subject locking device rotates with the rotatable cam actuating means of the connector and prevents rotation of the cam unless the board is properly positioned. The locking device can serve either as the driving member for the rotary cam or be rotated by the cam.

2 Claims, 5 Drawing Figures

ROTARY ZIF CONNECTOR EDGE BOARD LOCK

BACKGROUND OF THE INVENTION

1. Field of the Invention

The present invention relates to rotary cam actuated zero insertion force edge board connectors and in particular to a locking device to be used in combination such as a connector that is end loaded to assure that the contacts cannot be actuated until a circuit board is properly positioned in the connector.

2. The Prior Art

There are often instances in the electrical and electronic industry when it is desirable to have electrical connectors of the edge board type mounted in tandem to be end loaded so as to either engage edge portions of extremely large printed circuit boards or spaced and aligned pairs of boards. Usually the connectors are arranged in line with one connector being in a rather remote position. In the instance when there is one connector in a remote position and two separate boards are used, it is important to insure that the remote board be properly positioned to assure proper mating of the respective contacts with pads of the board.

The known rotary cam actuated, zero insertion force edge board connectors of the type suitable for use with the present invention is represented by U.S. Pat. No. 3,899,234.

SUMMARY OF THE INVENTION

The present invention includes a locking member to be used in conjunction with a rotary cam of a rotary cam actuated zero insertion force edge board connector. The locking member includes a driver portion having a through bore profiled to engage at least an end portion of the rotary cam and an integral radial flange profiled to mate with a portion of the housing and to provide a stop for the cam when rotated into abutment with the housing.

It is therefore an object of the present invention to produce a locking member for end loaded, rotary cam actuated, zero insertion force edge board connectors which can either be used to drive the cam or can be driven by the cam.

It is another object of the present invention to produce a locking member for end loaded, rotary cam actuated, zero insertion force edge board connectors which can be rotary driven by a nutdriver and/or a screwdriver.

It is still another object of the present invention to produce a locking member for end loaded, rotary cam actuated, zero insertion force edge board connectors which will assure proper positioning of a printed circuit board in the connector and prevent engagement of the connector contacts with the circuit board pads until the board is properly positioned.

It is yet another object of the present invention to produce a locking member for end loaded, rotary cam actuated, zero insertion force edge board connectors which will prevent removal of the circuit board from the connector while the contacts of the connector are in engagement with the circuit pads of the board.

It is a further object of the present invention to produce a locking member for end loaded, rotary cam actuated, zero insertion force edge board connectors which can be readily and economically manufactured.

The foregoing objects and other advantages of the present invention will be apparent to those skilled in the art from the following detailed description taken with reference to the accompanying drawings.

DETAILED DESCRIPTION OF THE PREFERRED EMBODIMENT

Figure 1:
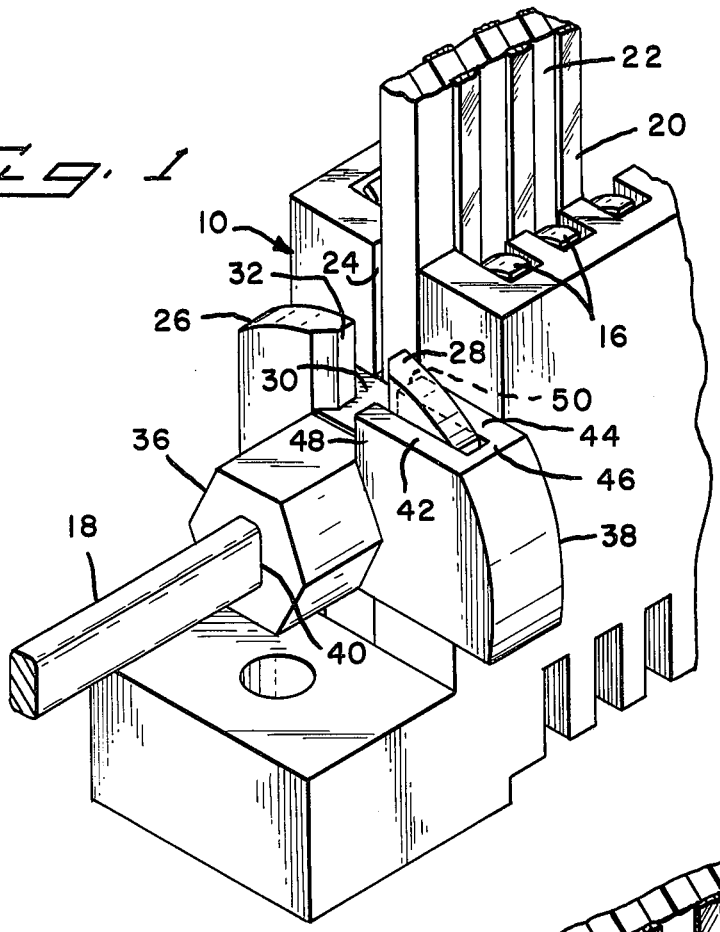
FIG. 1 is a perspective view of the preferred embodiment of the subject locking member for rotary cam actuated zero insertion force edge board connectors with the locking member shown in an unlocked condition.

The present invention is used in conjunction with an end loaded rotary cam actuated zero insertion force edge board connectors of the type disclosed in U.S. Pat. No. 3,899,234, the disclosure of which is incorporated herein by reference.

The connector 10 includes an elongated housing 12 having an elongated circuit board receiving recess 14 along one side thereof. A plurality of terminals 16 are spaced along at least one side of the recess 14 and are driven by cam 18, through a contact drive member (not shown), between positions for engaging pads 20 of circuit board 22 and being disengaged therefrom. The operation and structure of this connector being fully discussed in the noted patent.

The present connector has been modified from that shown in the noted patent. The present housing includes a slot 24 at the end of recess 14 generally forming an extension thereof to allow end loading of circuit boards into the connector. A pair of aligned flanges 26, 28 are spaced parallel to the end of the housing by shelf 30 and define a slot 32 therebetween in alignment with slot 24. The shelf 30 extends normal to the plane of the slots 24 and 32.

The subject locking member 34 includes a driving portion 36 and a rotary abutment portion 38. The driving portion 36 is here shown with an external hexagonal profile, suitable for being driven with a nutdriver, and a profiled bore 40 tightly engaging the cam 18. The rotary abutment portion includes a spaced pair of radially extending flanges 42, 44 joined at their remote ends by bight 46. The rotary abutment portion 38 is asymmetric with the driving portion 36 so that flanges 42, 44 form abutment shoulders 48, 50, respectively.

Figure 2:
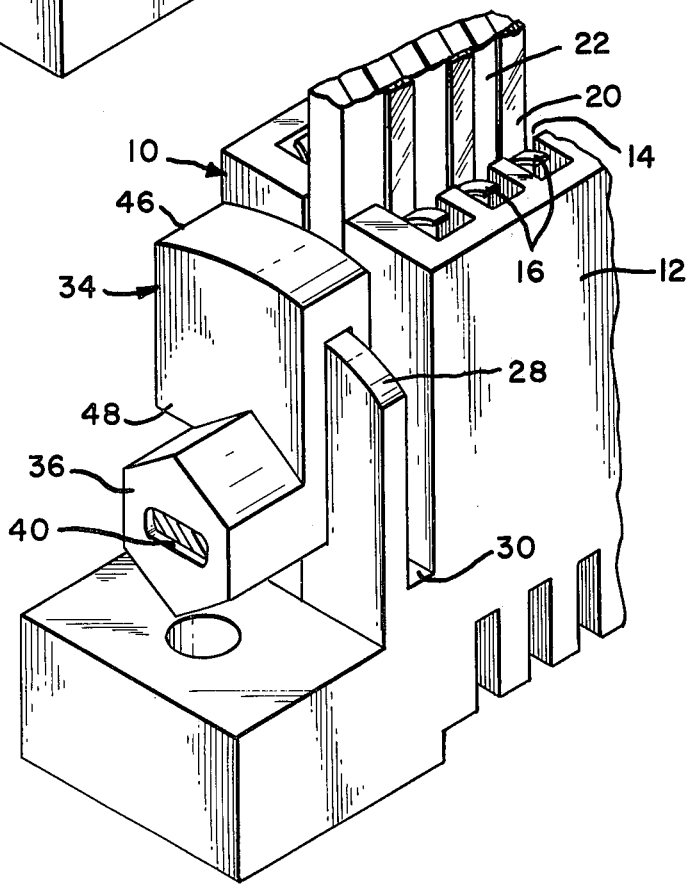
FIG. 2 is a view similar to FIG. 1 showing the locking member in the locked condition.

In operation, the locking member 34 is rotated to an open position, as shown in FIG. 1, by the rotation of cam 18. The slots 32 and 24 are opened to receive a board 22 therein with the terminals 16 lying in their out of contact position. The circuit board 22 is slid endwise into the connector 10 until the proper position is reached. The cam 18 is rotated to drive the locking member 34 and to bring the terminals 16 into engagement with the pads 20. If the board is properly positioned, then the locking member 34 will also rotate to the position shown in FIG. 2 with the shoulder 50 abutting with the shelf 30 of the housing 12 to prevent further rotation. If the circuit board 22 is not properly positioned, but projects slightly from the slot 24, then the shoulder 50 will engage the circuit board 22 and prevent rotation of the cam 18. Thus there will be no possibility of an erroneous engagement of a terminal 16 with a pad 20 on the circuit board to cause a possible delitorious effect to the related circuitry.

Figure 3:
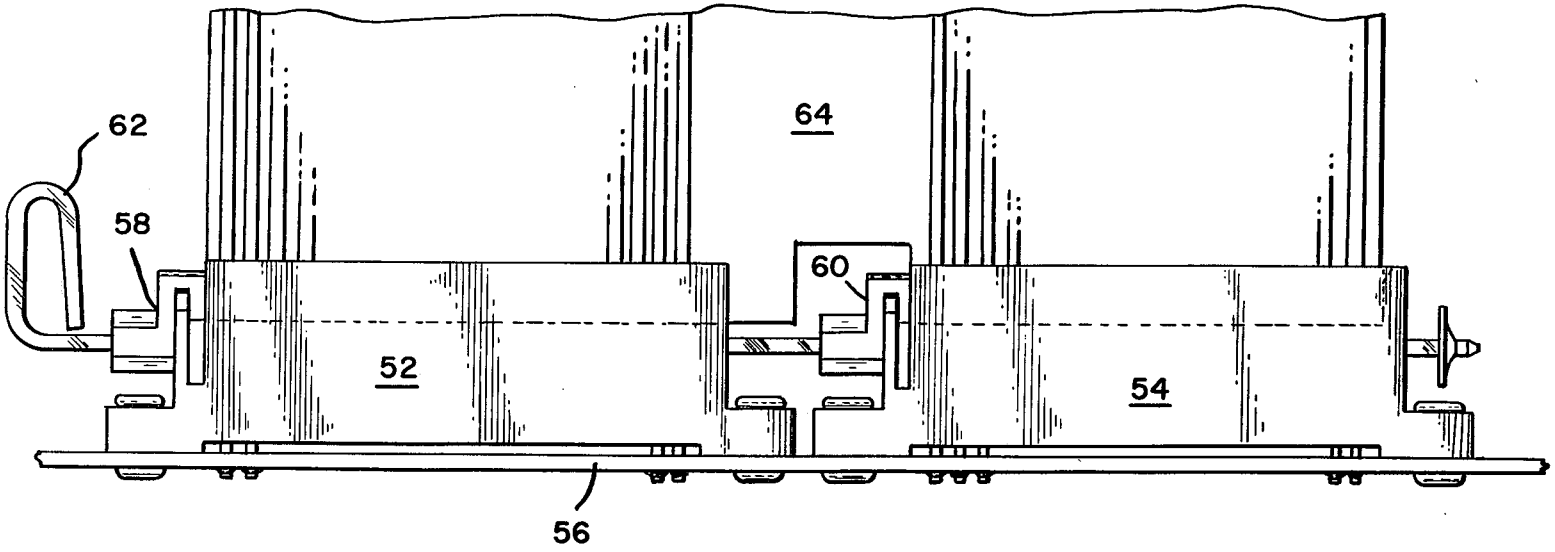
FIG. 3 is a side elevation showing a tandem arrangement of a pair of rotary cam actuated zero insertion force edge board connectors employing the subject locking member and engaging edge portions of a single large circuit board.

FIG. 3 shows a pair of rotary cam actuated zero insertion force edge board connectors 52, 54 secured to a circuit board 56 in an aligned and spaced condition. Each of the connectors is provided with a locking member 58, 60, respectively, and a single cam 62 is utilized to actuate both connectors. A single large board 64 is inserted endwise into the connectors. The locking members assure that the board is properly positioned in the connectors before the cam is free to rotate to the locked position.

Figure 4:
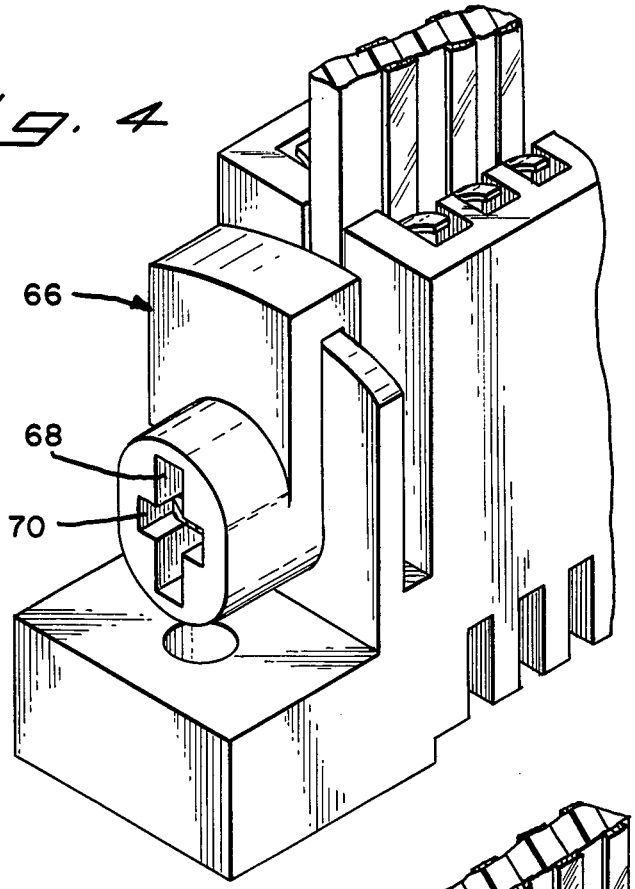
FIG. 4 is a perspective view of an alternate embodiment of the subject invention.

FIG. 4 shows an alternate embodiment of the locking member 66 with the previously described external hexagonal configuration being replaced by a more rounded profile and a screwdriver slot 68 being added. The member still has a cam slot 70, but the cam must be recessed, as shown, or slotted transversely (not shown) to allow insertion of a screwdriver blade to drive the cam and member in rotation.

Figure 5:
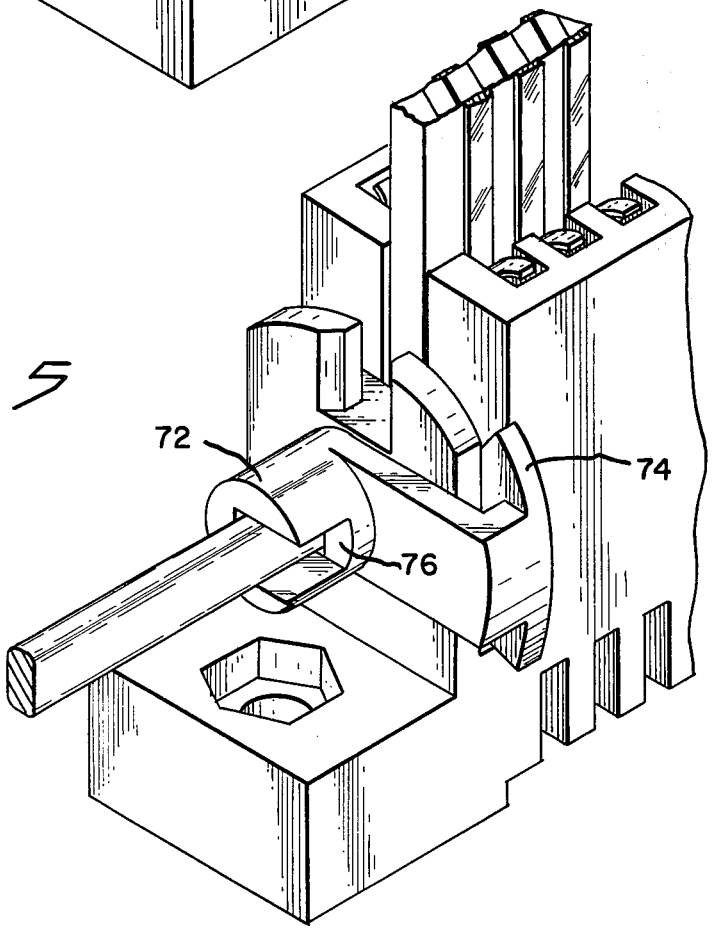
FIG. 5 is a perspective view of a further alternative embodiment of the present invention.

The embodiment of the locking member 72 shown in FIG. 5 differs from the previous embodiments in that the abutment flange 74 is profiled to allow rotation to an unlocked position on either side of the housing. The cam slot is also cut out at 76 to allow insertion of a cam handle such as that shown in FIG. 3.

The present invention may be subject to many modifications and changes without departing from the spirit or essential characteristics thereof. The present embodiments are therefore to be considered in all respects as being illustrative and not restrictive of the scope of the invention.

What is claimed is:

1. An end loading, rotary cam actuated, zero insertion force edge board connector having means to lock a circuit board therein, comprising:

an elongated connector housing having an elongated board receiving recess in one longitudinal surface;

a plurality of electrical terminals mounted in said housing in parallel spaced relationship along at least one elongated side of said recess;

an elongated cam member rotatably mounted in said housing extending along the bottom of said recess;

a terminal actuation member driven by said cam member and acting on said terminals to move them between a first position in engagement with pads of a circuit board received in said connector and a remote out of contact position;

a slot in one end of said housing forming an extension of said recess;

lock guide means having a pair of aligned flanges spaced from an end of said housing by an integral shoulder, said flanges defining therebetween a further slot aligned with the first slot; and a locking member adapted to be mounted on said lock guide means for rotation with said cam member, said locking member having a driving portion and an abutment portion, said driving portion having a profiled bore receiving at least a portion of said cam member therein and an external driving profile adapted to receive a driving means, said abutment portion having a pair of radial flange members one of which is integrally connected by one end to said driving portion, the other ends of said flanges being connected in parallel spaced relation by a bight, said flanges being asymmetric with said driving portion and spanning said lock guide means and engaging said shoulder upon rotation of said cam to a contact engaging position, said flanges engaging a mispositioned circuit board preventing rotation of said cam actuation means.

2. A board locking member adapted to be mounted on a rotary cam of an end loading, rotary cam actuated, zero insertion force edge board connector, said locking member comprising:

a driving portion having a profiled through bore receiving at least a portion of said rotary cam therein for movement therewith and an external profiled driving surface; and radial flange means integrally extending from said driving portion and defining an abutment shoulder, said shoulder engaging mispositioned circuit boards so as to prevent rotation of said cam thereby preventing erroneous engagement of connector terminals with circuit board pads.

* * * * *